US007152248B2

(12) United States Patent
Ziemer

(10) Patent No.: US 7,152,248 B2
(45) Date of Patent: Dec. 26, 2006

(54) FLASHLIGHT GLOVES

(76) Inventor: Rick L. Ziemer, 1792 Sunrise Pass Rd., Minden, NV (US) 89423

( * ) Notice: Subject to any disclaimer, the term of this patent is extended or adjusted under 35 U.S.C. 154(b) by 42 days.

(21) Appl. No.: 11/103,528

(22) Filed: Apr. 12, 2005

(65) Prior Publication Data

US 2006/0225184 A1 Oct. 12, 2006

(51) Int. Cl.
*A41D 19/00* (2006.01)

(52) U.S. Cl. ..... 2/160; 2/159; 2/161.1; 2/247; 2/250; 2/251; 362/103

(58) Field of Classification Search ..... 2/161.1, 2/160, 247, 250, 251, 159; 362/103
See application file for complete search history.

(56) References Cited

U.S. PATENT DOCUMENTS

| | | | | | |
|---|---|---|---|---|---|
| 1,015,715 | A | | 1/1912 | Schindler | |
| 1,982,431 | A | * | 11/1934 | Hines | 2/160 |
| 3,189,073 | A | * | 6/1965 | Todd | 224/222 |
| 5,003,637 | A | * | 4/1991 | Lonon | 2/160 |
| 5,124,892 | A | | 6/1992 | Lambert | |
| 5,154,506 | A | | 10/1992 | Leard | |
| 5,283,722 | A | * | 2/1994 | Koenen et al. | 362/570 |
| 5,345,368 | A | * | 9/1994 | Huff | 362/103 |
| 6,592,235 | B1 | | 7/2003 | Mayo | |
| 6,709,142 | B1 | | 3/2004 | Gyori | |
| 6,892,397 | B1 | * | 5/2005 | Raz et al. | 2/160 |
| 2001/0048596 | A1 | | 12/2001 | Kerr | |
| 2004/0255361 | A1 | | 12/2004 | Senter et al. | |

OTHER PUBLICATIONS

Shop•Com, http://amos.shop.com/amos/cc/main/ccn_searc/st/work%20glove%20with%20light/sy/produ . . . p. 1 of 3, printed from the Internet Jan. 31, 2005.

* cited by examiner

*Primary Examiner*—Gary L. Welch
*Assistant Examiner*—Alissa J. Tompkins
(74) *Attorney, Agent, or Firm*—Richard C. Litman

(57) ABSTRACT

The flashlight glove is a hand glove having at least a glove back portion and fingers having an LED flashlight held in a pocket of elastic web material located on the glove back portion. The LED flashlight is substantially contained within the pocket with the face facing toward said glove back portion, the actuation switch and extender button extending toward the glove back portion. The pocket is dimensioned so as to allow the extender button and actuation switch to remain in an inactive extended position upon the glove back portion and fingers being in a rest position with the wearer's palm open. The pocket is of material of such elasticity to force the extender button and actuation switch into a closed position upon the wearer clenching a partial fist and thereby stretching the pocket against the back of said LED flashlight.

5 Claims, 6 Drawing Sheets

FLASHLIGHT GLOVES

BACKGROUND OF THE INVENTION

1. Field of the Invention

The present invention relates to lighting devices. More particularly, the present invention relates to a glove-borne LED flashlight.

2. Description of the Related Art

The use of gloves with flashlight attachments has become practical, as flashlights have been miniaturized. Such gloves are particularly useful for mechanical or electrical work in dark locations such as in basements. The LED light is an example of miniaturization useful with work gloves as described by SHOP•COM on their Internet page of Jan. 31, 2005 showing such a work glove made by TOOL KING and described as Mechanix Wear LGS01009, Light Glove-Mechanic Glove with LED light at http://amos.shop.com. Showing an LED flashlight mounted on the back of a work glove which requires the use of the other hand to turn on the switch. It would be desirable to provide such a glove which may be turned on and off without the use of the other hand, freeing the other hand to hold a tool.

None of the above inventions and patents, taken either singly or in combination, is seen to describe the instant invention as claimed. Thus, a flashlight gloves solving the aforementioned problems is desired.

SUMMARY OF THE INVENTION

The flashlight glove of the present invention is a mechanic's hand glove having at least a glove back portion and fingers. An LED flashlight having a front end having a light beam lens, a face and opposed back, a rear, and opposed sides and having an actuation switch on the face with an extender button actuating said flashlight to produce a light beam from said lens is held in a pocket of elastic web material located on the glove back portion. The front end of the LED flashlight extends forward through a pocket opening defined by the pocket and glove back portion. The LED flashlight is substantially contained within the pocket with the face facing toward the glove back portion, the actuation switch and extender button extending toward the glove back portion.

The pocket is dimensioned so as to allow the extender button and actuation switch to remain in an inactive extended or normally-open position upon the glove back portion and fingers being in a rest position with the wearer's palm open. The pocket is of material of such elasticity to force the extender button and actuation switch into a closed position upon the wearer clenching a partial fist and thereby stretching the pocket against the back of said LED flashlight.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a flashlight glove, i.e., a glove such as a work glove having a pocket mounted on the back portion of the glove of such size and proportions as to carry an LED flashlight. The LED flashlight is modified by adding an extender button to the switch button of the flashlight. The LED flashlight is inserted in the pocket with the switch and extender buttons facing the back portion of the glove and therefore the back of the hand on which the glove is worn. The pocket and glove material are elastic such that when the wearer makes a partial fist, the switch is activated turning the flashlight on, the flashlight remaining on until the partial fist is relaxed.

Figure 1:
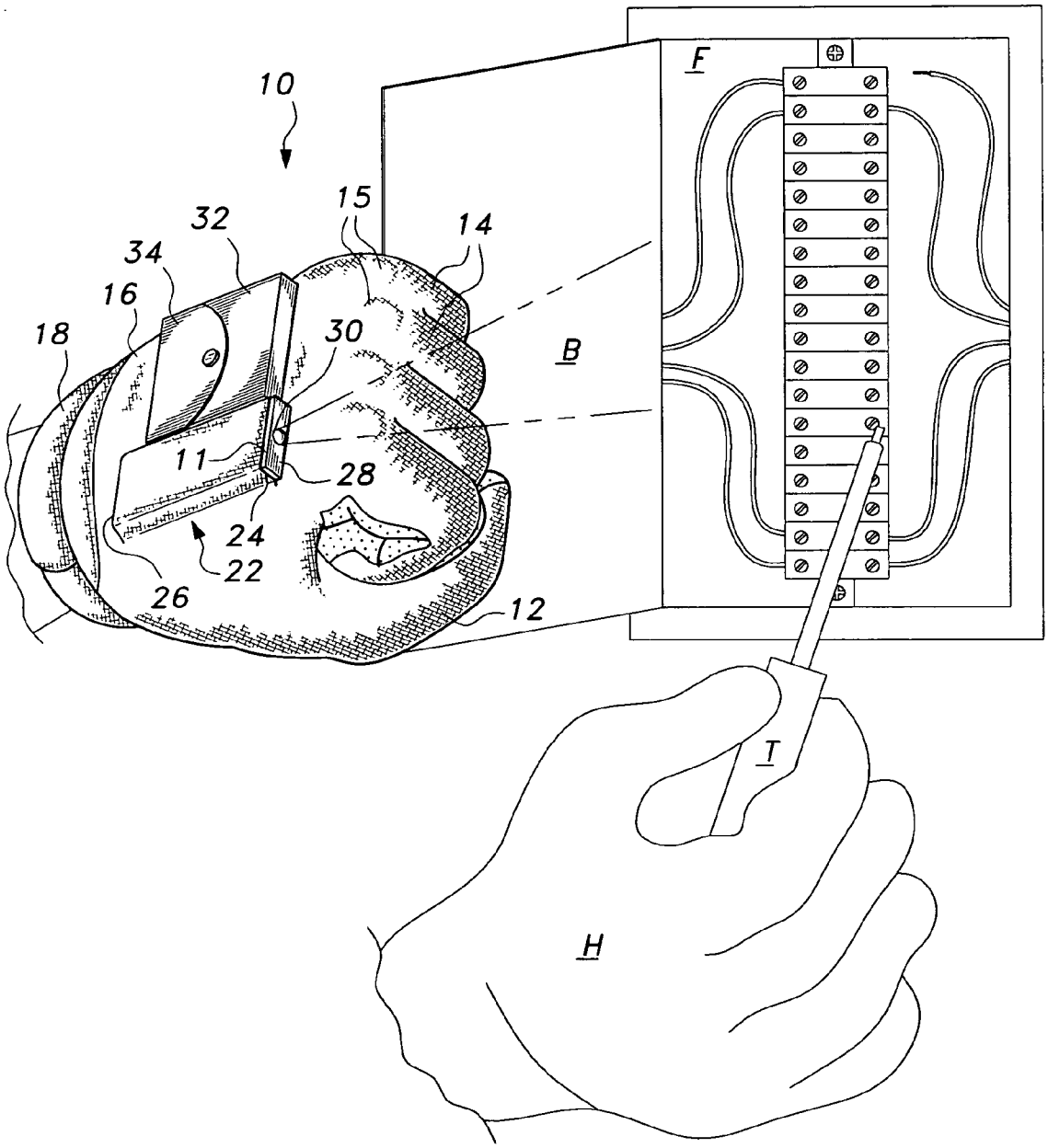
FIG. 1 is an environmental, perspective view of a flashlight glove according to the present invention.

Referring to the FIG. 1, there is shown an environmental perspective view of the flashlight glove in use. Flashlight glove 10 is shown with the flashlight 11 activated by making a partial fist in the glove 10. Flashlight 11 gives off a beam B of light so the wearer may see to use his free hand H to inspect fuse box F using tool T.

Figure 2:
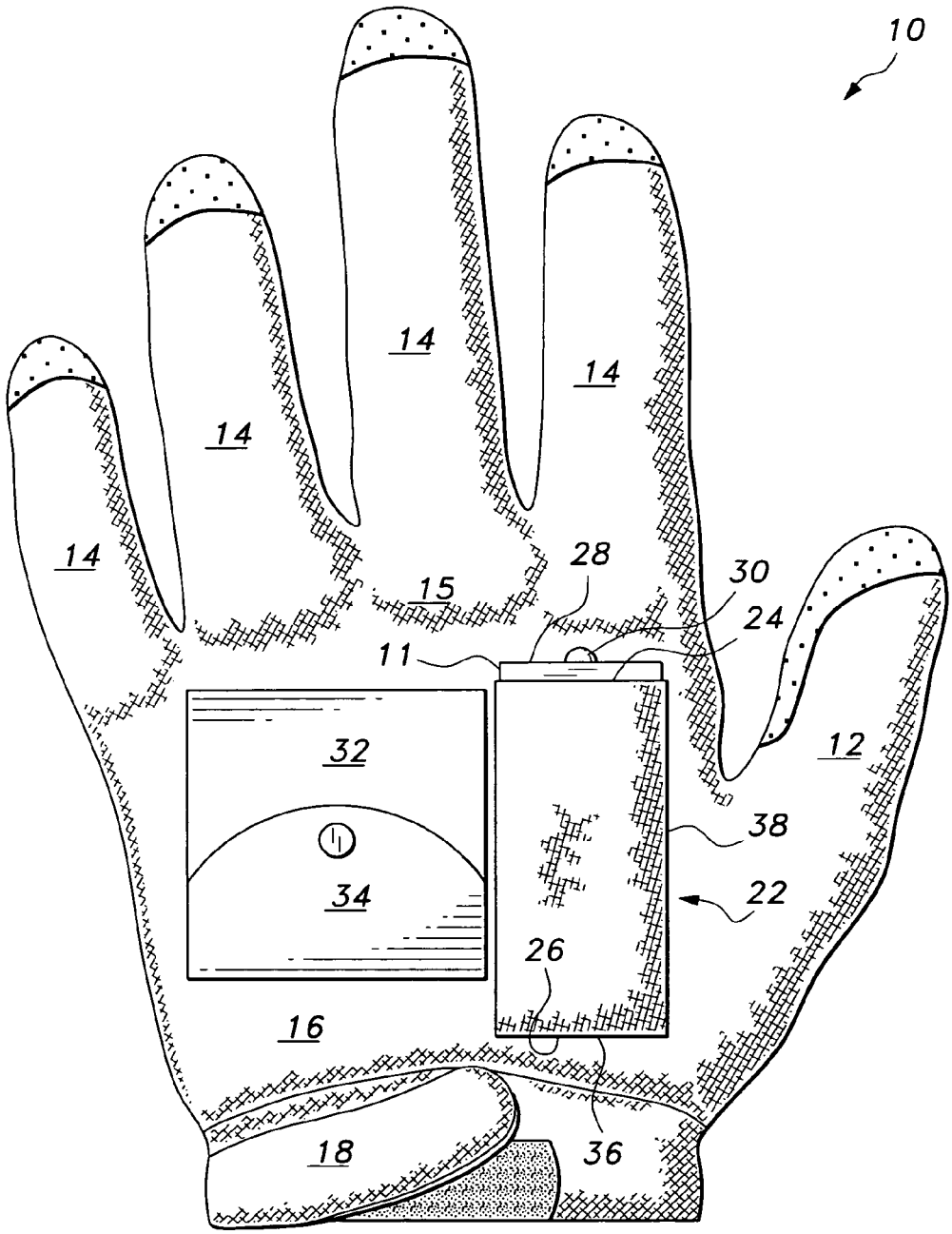
FIG. 2 is a plan view of the glove of the flashlight glove of FIG. 1 with the palm open.
Figure 3:
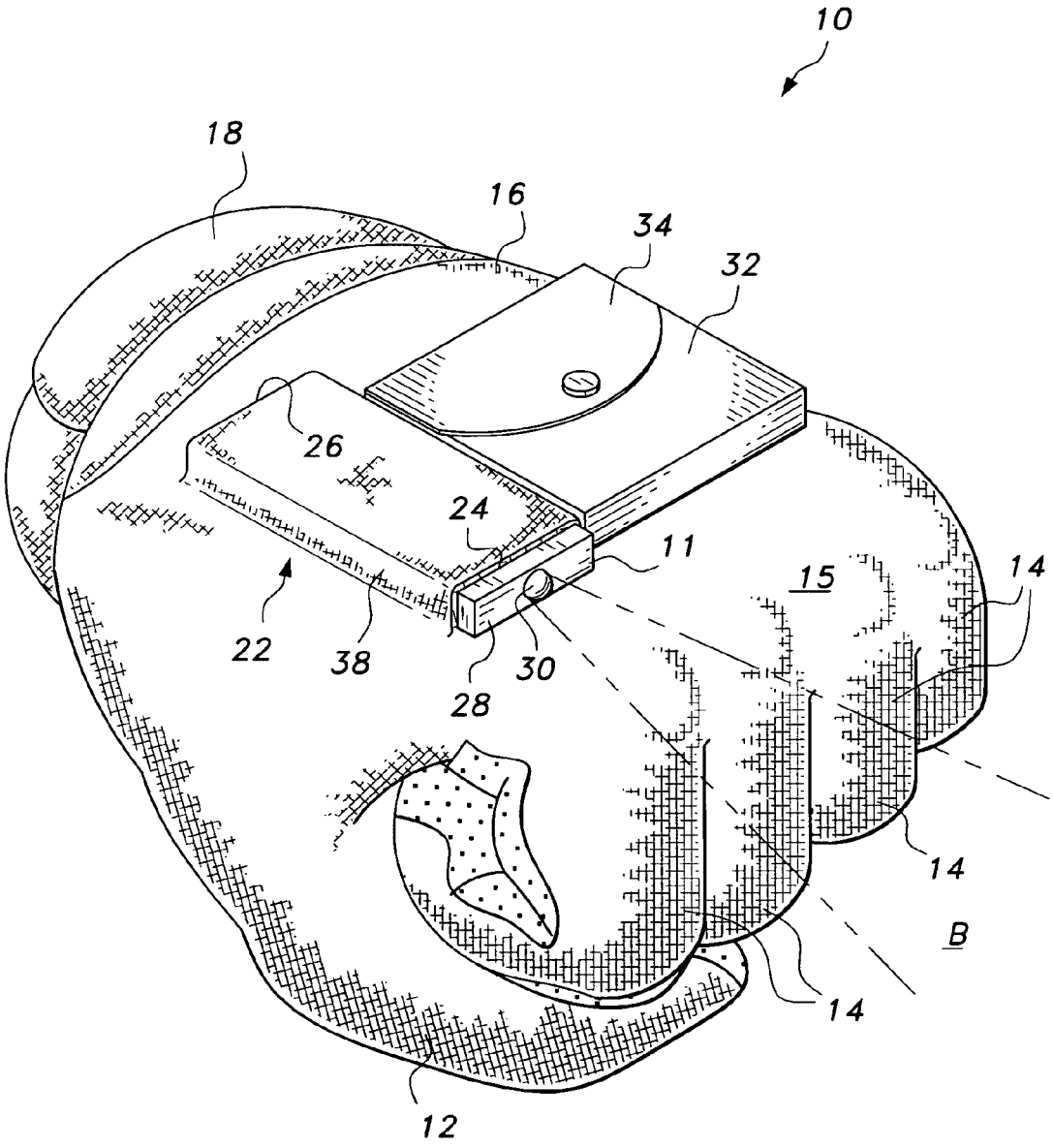
FIG. 3 is a perspective view of the flashlight glove of FIG. 1 in the flashlight-activated position.

Referring to FIGS. 1–3, flashlight glove 10 has glove thumb 12, fingers 14, knuckles 15, a back portion 16, a cuff 18 and a palm 20. An elastic pocket 22 of elastic web material such as elastic fabric is sewn or otherwise affixed to the back 15 of glove 10, the glove back portion 15 preferably also being made of elastic material. The LED flashlight 11 is carried in elastic pocket 22 having an opening 24 facing forward along glove back portion 16 and over a knuckle 15. Pocket 22 has a closed rear 26 and sides 38. Flashlight 11 is shown having a forward end 28 having a centrally located flashlight beam lens 30 to produce the beam of light B in a forward direction. A carrying pouch 32 is shown mounted on the glove back portion 16, the pouch 32 having a snap flap closure 34 and is useful for carrying articles such as tools, spare fuses, or fasteners. Carrying pouch 32 has a rear end 36 and sides 38 and is mounted to glove back 16 by sewing, adhesive, or the like.

Figure 4A:
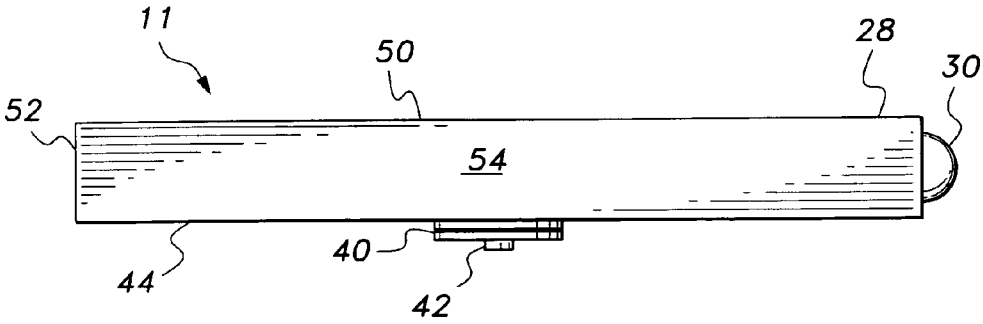
FIG. 4A is a side elevation view of a modified LED flashlight as in FIG. 1.
Figure 4B:
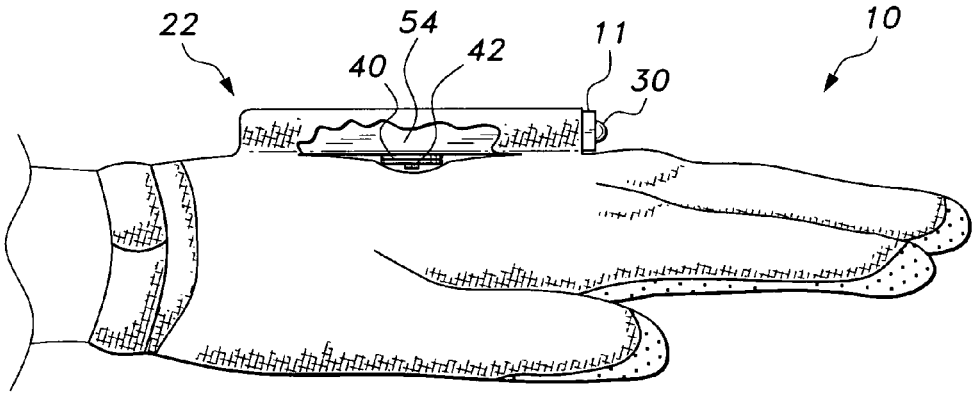
FIG. 4B is a side elevation view partially broken away of the flashlight glove of FIG. 1 in the relaxed, palm open, inactivated position.
Figure 4C:
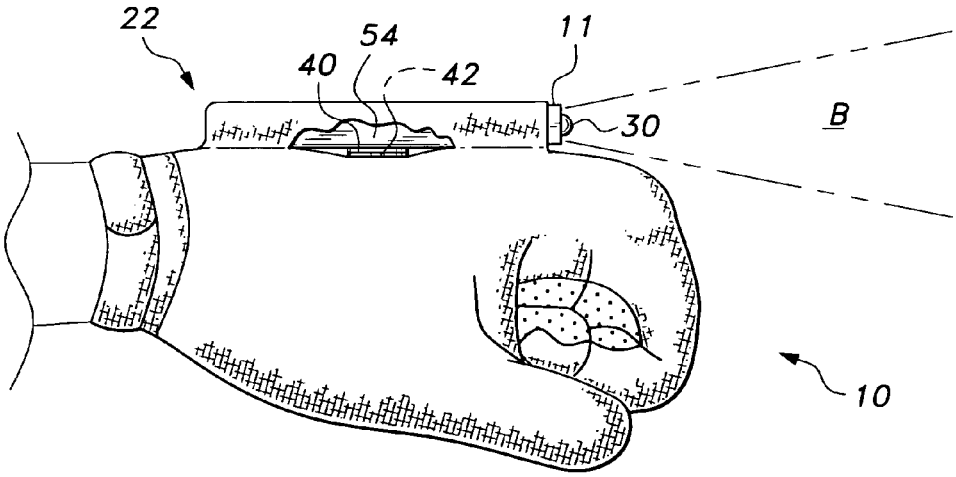
FIG. 4C is a side elevation view partially broken away of the flashlight glove of FIG. 1 in the partially clenched fist activated position.

Referring to FIGS. 4A–4C LED flashlight 11 has a face 44, a back 50, a rear end 52 and sides 54 as best seen in FIG. 4A. Face 44 has a conventional actuating switch 40 to which an extender button 42 is attached as by adhesive or molded as a unitary member. As seen in FIG. 4B there is shown the flashlight glove 10 worn in a relaxed configuration with an open palm. The elastic pocket is partially cut away to show the flashlight side 54, the actuating switch 40 and the extender button 42 in the non-actuated position. The elastic pocket 22 is sewn so as to leave slack between the back 16 (see FIG. 1) of the glove.

Alternatively, the back of the glove may be of elastic material which, in the relaxed state, does not actuate switch 40. As shown in FIG. 4C, when the wearer of the glove makes a partial fist, elastic pocket 22 is stretched and thereby compresses extender button 42 against the back of the wearer's hand actuating the LED light 11 by means of actuator button 40 which produces light beam B through lens 30. Upon relaxing the glove into the configuration of FIG. 4B, the switch 40 of light 22 is released, turning the light off.

Figure 5:
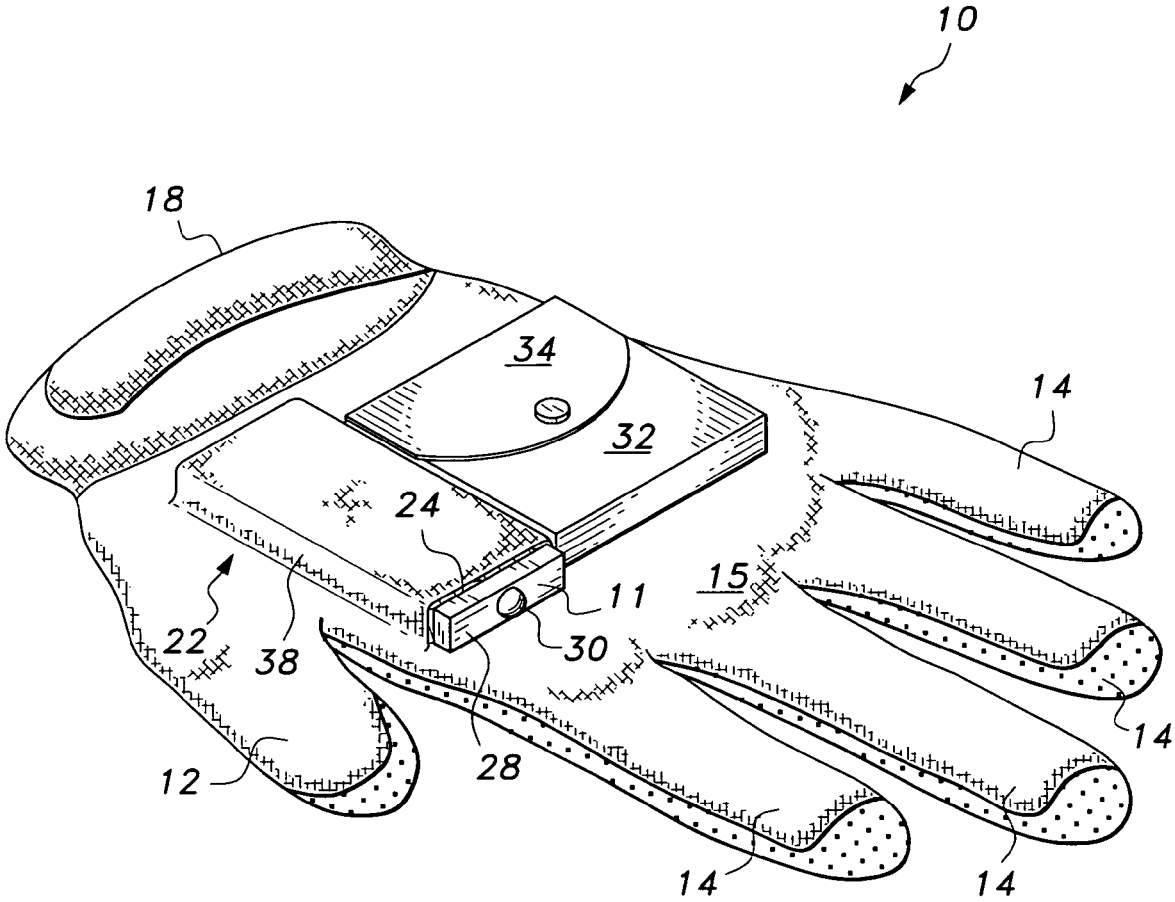
FIG. 5 is a perspective view of the flashlight glove of FIG. 1 in the palm open, relaxed, inactive position.
Figure 6:
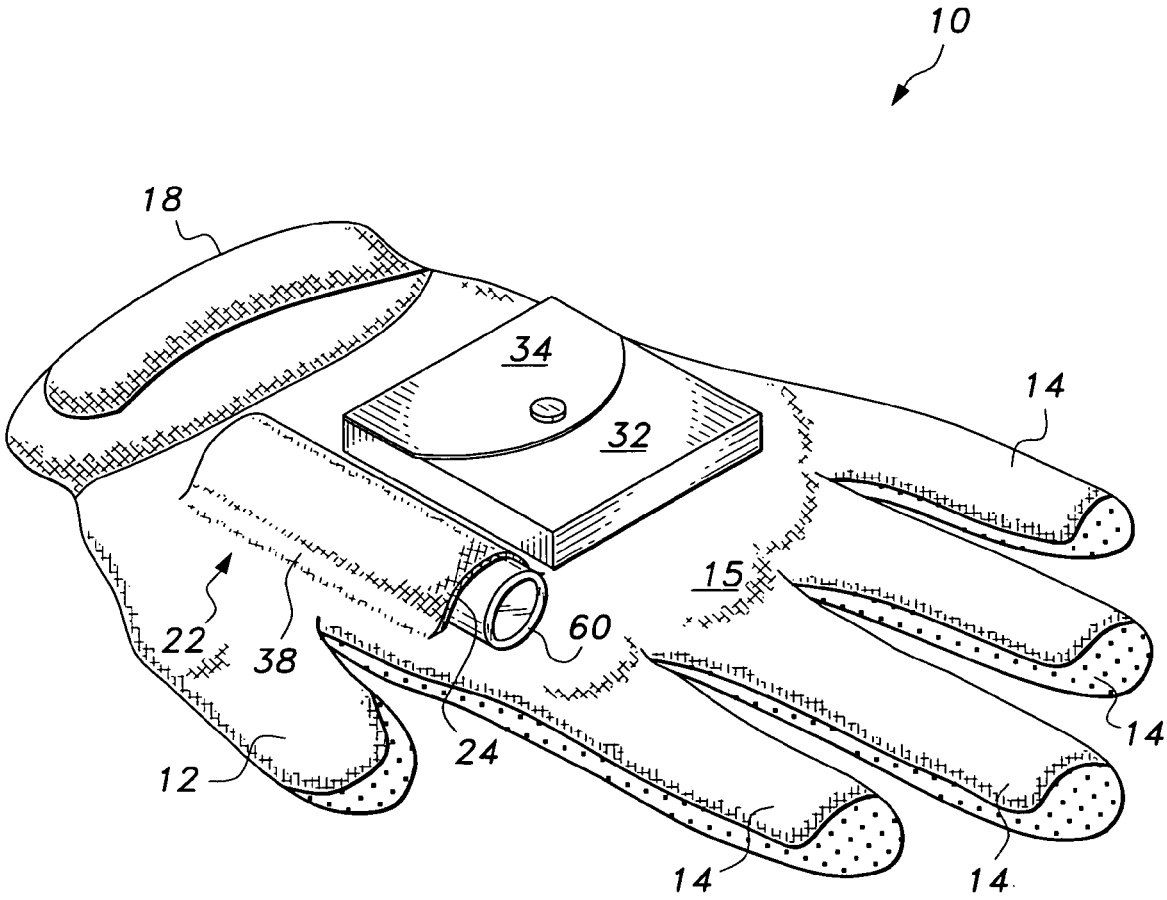
FIG. 6 is a perspective view similar to FIG. 5 with a mini-cylindrical flashlight in the flashlight pocket.

Referring to FIG. 5, there is shown a perspective view of the flashlight glove 10 in a relaxed position. The flashlight forward end 28 is shown partially removed from the elastic pocket 22. Elastic pocket 22 may also be used to carry a cylindrical mini-flashlight as shown in FIG. 6.

Although the elastic pocket 22 on flashlight glove 10 is shown with the beam B directed forward over a knuckle 15, it may be oriented in another direction relative to the glove as desired.

It is to be understood that the present invention is not limited to the embodiments described above, but encompasses any and all embodiments within the scope of the following claims.

I claim:

1. A flashlight glove, comprising:

a hand glove having at least a glove back portion and fingers;

an LED flashlight having a front end having a light beam lens, a face and opposed back, a rear, and opposed sides;

said LED flashlight having an actuation switch on said face actuating said flashlight to produce a light beam from said lens;

said actuation switch having an extender button extending therefrom;

a pocket of elastic web material located on said glove back portion, said pocket and glove back defining an enclosed pocket and having an opening facing forward along the glove back portion towards the fingers and over a knuckle of a wearer's hand;

said LED flashlight being substantially contained within said pocket with said face facing toward said glove back portion, said actuation switch and said extender button extending toward and being confined by said glove back; and said pocket being so dimensioned as to allow said extender button and actuation switch to remain in a normally-open position upon said glove back and fingers being in a rest position with the wearer's palm open and is of such elasticity as to force said extender button and actuation switch into a closed position upon the wearer partially clenching a fist and thereby stretching said pocket against said back of said LED flashlight.

2. The flashlight glove of claim 1, wherein said glove back portion is made of elastic web material.

3. The flashlight glove of claim 2, wherein said glove back portion of said glove and said elastic pocket are made of elastic textile material.

4. The flashlight glove of claim 1, further comprising a carrying pouch having a snap closure mounted on said glove back portion adjacent said elastic pocket.

5. The flashlight glove of claim 1, wherein said pocket, upon removal of said LED light, receives and holds a generally cylindrical mini-flashlight.

* * * * *